US007137694B2

(12) United States Patent
Ferran et al.

(10) Patent No.: US 7,137,694 B2
(45) Date of Patent: Nov. 21, 2006

(54) INK DRYING SYSTEM FOR PRINTER

(75) Inventors: Jordi Ferran, Barcelona (ES); Xavier Soler, Barcelona (ES); Carles Boy, Barcelona (ES); Alejandro Manuel de Pena, Barcelona (ES); Jorge Menendez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 288 days.

(21) Appl. No.: 10/674,112

(22) Filed: Sep. 29, 2003

(65) Prior Publication Data

US 2005/0068396 A1 Mar. 31, 2005

(51) Int. Cl.
*B41J 2/01* (2006.01)

(52) U.S. Cl. ..... 347/102; 347/101

(58) Field of Classification Search ..... 347/101, 347/102, 19, 5, 6, 8, 17, 14, 7; 34/1
See application file for complete search history.

(56) References Cited

U.S. PATENT DOCUMENTS

| | | | | |
|---|---|---|---|---|
| 3,584,389 | A * | 6/1971 | Hilton et al. | 34/265 |
| 4,264,293 | A | 4/1981 | Rourke | |
| 4,970,528 | A | 11/1990 | Beaufort et al. | |
| 5,005,025 | A | 4/1991 | Miyakawa et al. | |
| 5,214,442 | A | 5/1993 | Roller | |
| 5,274,400 | A | 12/1993 | Johnson et al. | |
| 5,287,123 | A | 2/1994 | Medin et al. | |
| 5,500,667 | A | 3/1996 | Schwiebert et al. | |
| 5,510,822 | A | 4/1996 | Vincent et al. | |
| 5,633,668 | A | 5/1997 | Schwiebert et al. | |
| 5,668,584 | A | 9/1997 | Broder et al. | |
| 5,691,756 | A | 11/1997 | Rise et al. | |
| 5,754,208 | A | 5/1998 | Szlucha | |
| 6,132,038 | A | 10/2000 | Szlucha | |
| 6,238,046 | B1 | 5/2001 | Donahue | |
| 6,244,700 | B1 | 6/2001 | Kimura et al. | |
| 6,305,796 | B1 | 10/2001 | Szlucha et al. | |
| 6,406,140 | B1 | 6/2002 | Wotton et al. | |
| 6,428,158 | B1 | 8/2002 | Szlucha | |
| 6,508,552 | B1 * | 1/2003 | Steinfield et al. | 347/102 |
| 2001/0052920 | A1 * | 12/2001 | Matsumoto et al. | 347/102 |
| 2003/0222960 | A1 * | 12/2003 | Takabayashi | 347/102 |

* cited by examiner

*Primary Examiner*—Manish S. Shah

(57) ABSTRACT

An ink drying system for printer includes an IR heating element. A guide is configured to concentrate heat energy from the IR heating element to warm print media. A controller is configured to control operation of the IR heating element.

11 Claims, 7 Drawing Sheets

INK DRYING SYSTEM FOR PRINTER

BACKGROUND

Failure of ink to dry rapidly in a printer results in degradation of the print quality. For example, where ink applied to media such as paper does not dry rapidly, undesired mixing of different colors of ink can result. Additionally, slow ink drying times enables ink applied to media to move somewhat before drying. And further, where ink does not dry quickly, deformation of the paper to which it is applied may result, causing cockle, wrinkle and warp. Accordingly, a solution to the above problems would be beneficial.

SUMMARY

An ink drying system for printer includes an IR heating element. A guide is configured to concentrate heat energy from the IR heating element to warm print media. A controller is configured to control operation of the IR heating element.

BRIEF DESCRIPTION OF THE DRAWINGS

The following detailed description refers to the accompanying figures. In the figures, the left-most digit(s) of a reference number identifies the figure (Fig.) in which the reference number first appears. Moreover, the same reference numbers are used throughout the drawings to reference like features and components.

DETAILED DESCRIPTION

Figure 1:
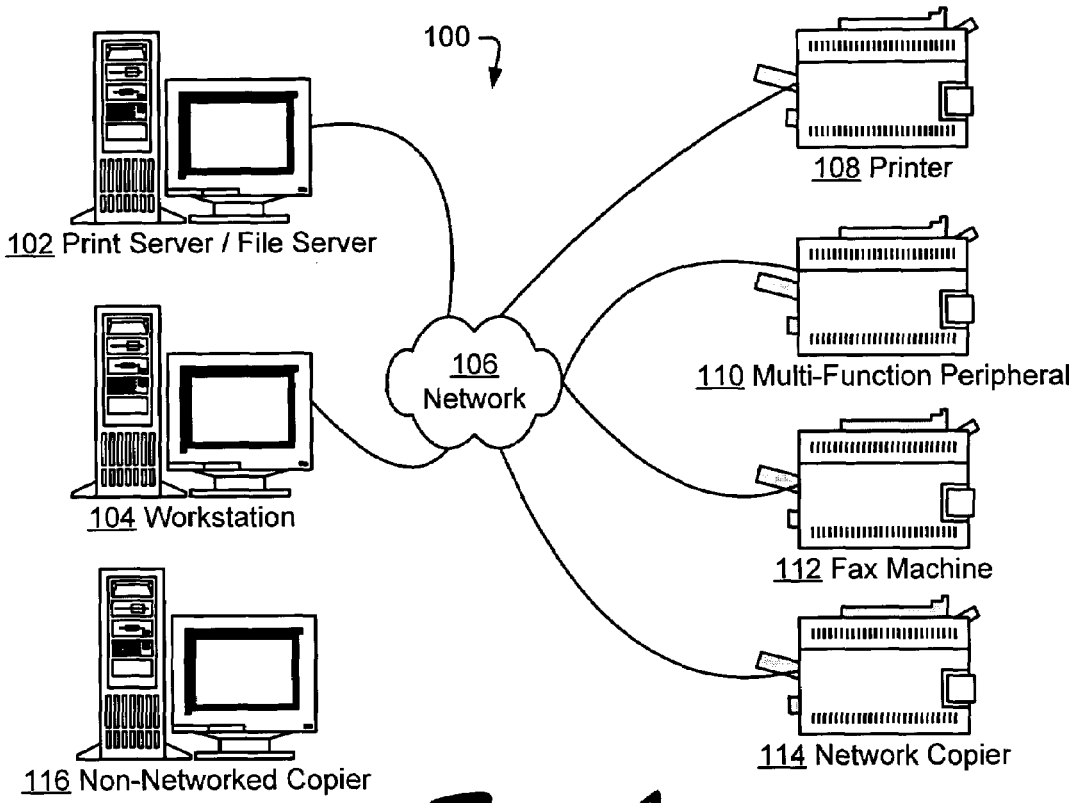
FIG. 1 illustrates examples of print systems within which versions of an ink drying system for a printer could be utilized.

FIG. 1 shows an exemplary environment 100 within which versions of the ink drying system may be employed. A print server 102 and workstation 104 may communicate over a network 106 with a plurality of devices, within any of which a version of the ink drying system could be employed. For example, an inkjet printer 108, a multi-function peripheral 110, a fax machine 112 and a network copier 114 may all be configured to use versions of the ink drying system and method. Additionally, a non-networked copy machine 116 may also be configured to use a version of the ink drying system and method.

Figure 2:
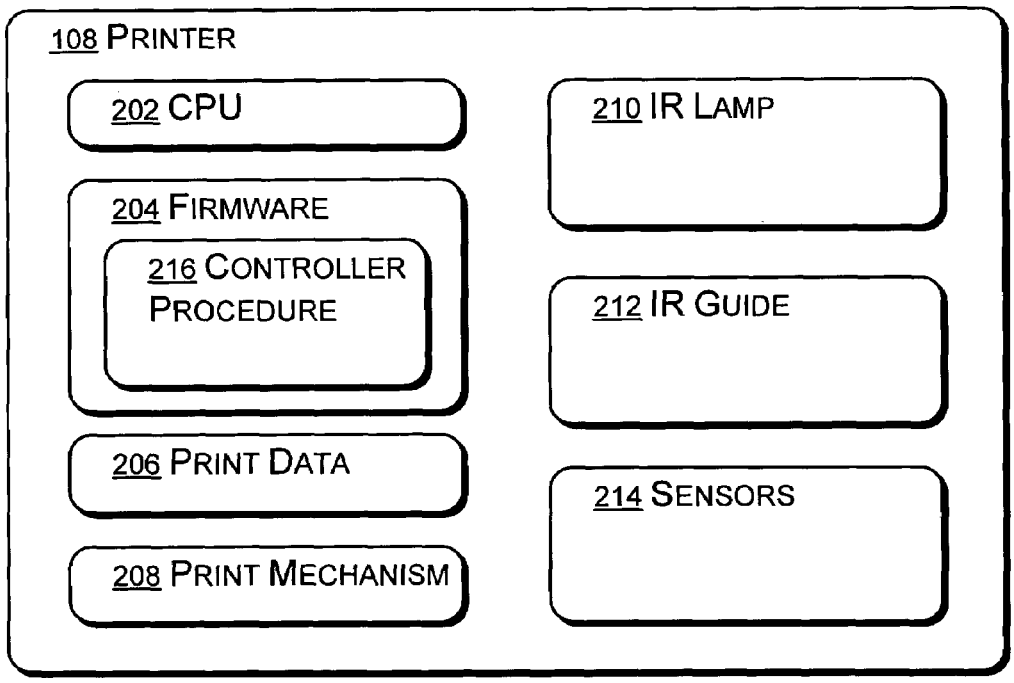
FIG. 2 is block diagram showing an exemplary embodiment of an ink drying system for a printer.

FIG. 2 is a block diagram illustrating additional detail of the printer 108. In particular, a CPU 202 executes instructions contained within firmware 204 to process print data 206 for output by a print mechanism 208. An energy source, such as an IR lamp 210 using a guide 212 is configured to assist in drying print media processed by the print mechanism 208. In one implementation, the IR lamp 210 is selected to emit medium-far IR light wavelengths which are particularly suited for absorption by water. For example, light having a wave length of between 2.5 to 3.5 um and around 10 um tends to be more easily absorbed by water than light having alternate wavelengths. As a result, less overall IR energy is required to dry the ink. While the particular IR lamp selected will vary depending on the requirements of the print system, a 120V, 250 W lamp may be use with success in many applications.

As will be seen in greater detail below, IR guides 212 having a plurality of configurations may be used to guide the IR emitted from the IR lamp 210 to areas wherein the IR is needed to dry ink on the print media. For example, some embodiments of the ink drying system may provide IR to the media at locations along a path followed by the printhead before, during and/or after arrival of the printhead.

Sensors 214 may monitor the ambient temperature and humidity within which the printing device is operating. Using information from the sensors, the may IR lamp 210 operated to produce a desired amount of IR energy. For example, the IR lamp 210 may be turned on and off, or its output turned up or turned down, based on the ambient temperature and/or humidity within which the print media is drying.

A controller procedure 216 may be executed by the CPU 202, and thereby process data and/or signals from the sensors 214, which may include information on temperature and humidity. Additionally, the controller procedure 216 may examine the print data 206 to determine which areas of the print media have received, or will receive, different quantities of ink, and which therefore require, or will require, different quantities of IR energy. The controller procedure 216 may also examine the print data 206 to determine areas wherein greater or lesser amounts of ink was/will be applied. IR energy may then be applied according to the data, to provide extra energy to areas to which more ink was/will be applied, particularly including locations wherein several passes of one or more printheads applied ink liberally.

Figure 3:
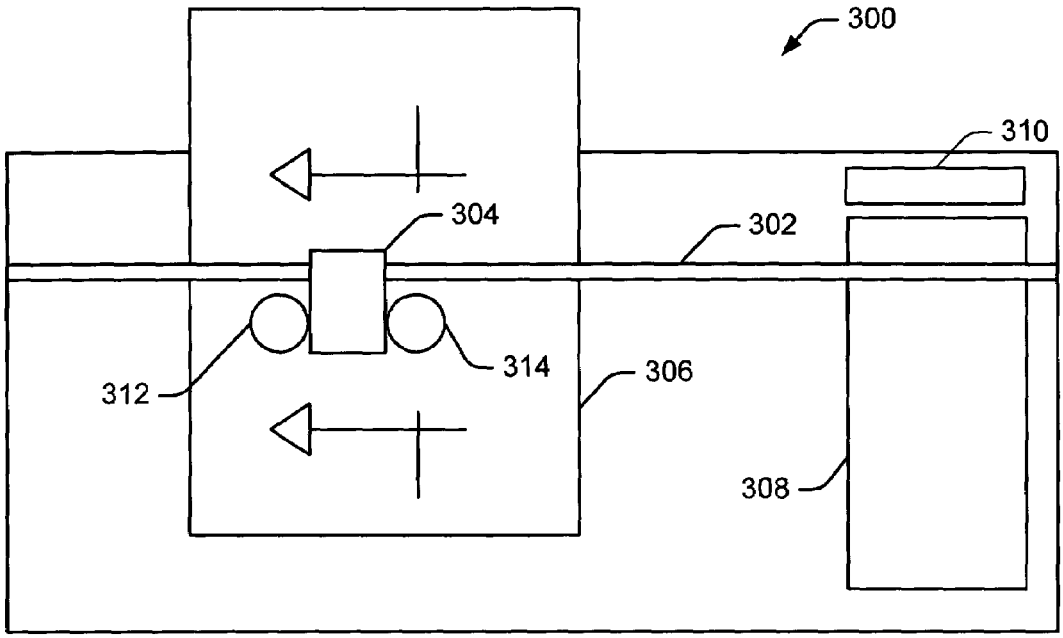
FIG. 3 is an exemplary embodiment of the invention, particularly showing a diagrammatic view of a printer, wherein a printhead is bracketed by left and right IR lamps and IR guides.

FIG. 3 is an exemplary diagrammatic view of a printer 300 having an implementation of an ink drying system. A carriage rod 302 allows a carriage supporting a printhead 304 to be moved across a paper path through which print media, such as paper 306, passes. A service station 308 is configured for printhead maintenance. A circuit card 310 may be configured to carry the CPU 202, firmware 204 and sensors 214. Left and right ink drying devices 312, 314 bracket the printhead 304. The ink drying devices, whose structure is discussed in greater detail below, may be used to preheat the print media before application of the ink, and/or to heat ink already applied to the print media.

Figure 4:
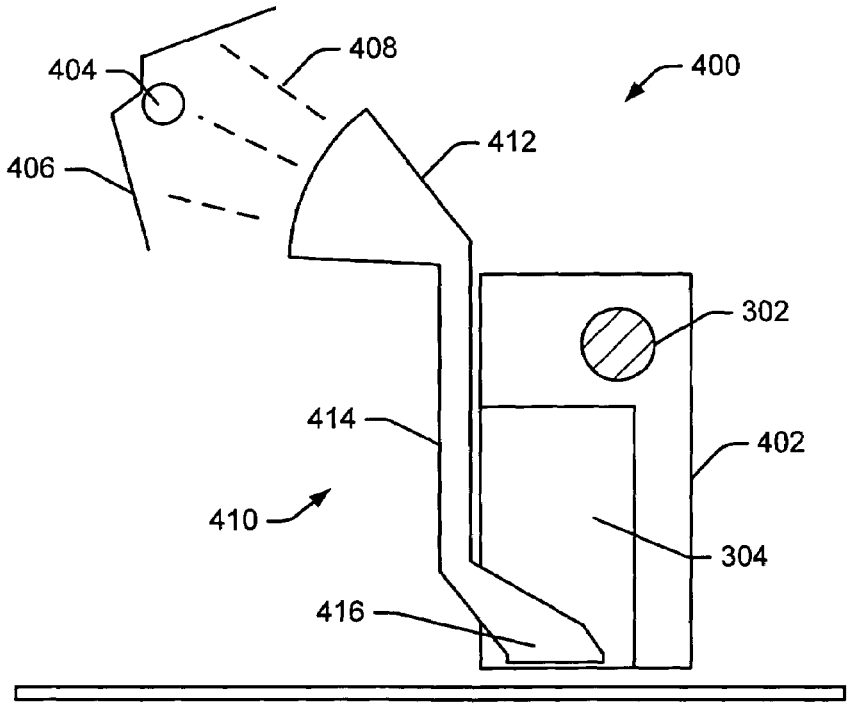
FIG. 4 is a diagram illustrating a first exemplary embodiment of the invention, wherein an IR lamp and guide concentrate heat energy.

FIG. 4 is a diagram illustrating an exemplary ink drying device or heater 400 for accelerating the drying process of ink applied to print media. In the implementation of FIG. 4, the printhead 304 is supported by a carriage 402, which in turn is supported by the carriage rod 302. An IR lamp or bulb 404 produces IR radiation 408 which is directed by a compound guide to be concentrated on a desired location on the print media. In the example of FIG. 4, the compound guide includes a reflector 406 and a light pipe 410. The reflector is positioned near the bulb 404 to direct IR radiation 408 toward a light pipe 410. The exemplary light pipe includes a collector 412, a pipe 414 and an emitter 416.

The light pipe may be made of a variety of materials. In general, highly reflective internal surfaces will result in better IR transmission. For example, a hollow metal waveguide having an interior surface made of silver or similar metal may result in efficient IR transmission. Additionally, the below list includes several exemplary materials from which the light pipe may be constructed.

1. Glass

A. Heavy metal fluoride HMFG
ZBLAN—(ZrFM4-BaF2-LaF3-AIF3-NaF)

B. Germanate GeO2-PbO

C. Chalcogenide As2S3 and AsGeTeSe

2. Crystal

A. Polycrystalline—PC AgBrCl

B. Single crystal—SC Sapphire

3. Hollow waveguide

A. Metal/dielectric film Hollow glass waveguide

B. refractive index<1 Hollow sapphire at 10.6 um

In some applications, a plastic wave guide having sufficiently reflective interior surfaces may also result in satisfactory performance. Additionally, IR fiber optical material may be used to form an IR guide.

Figure 5:
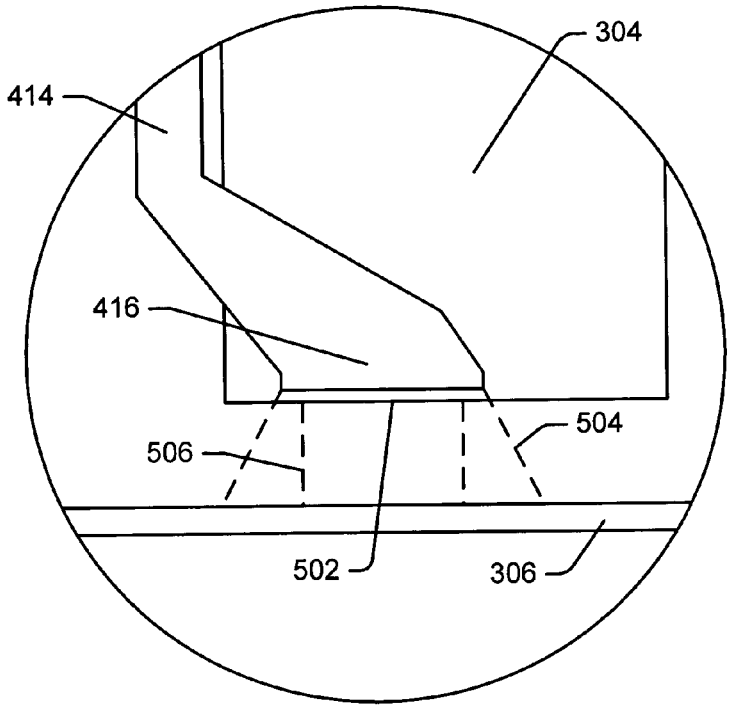
FIG. 5 is an enlargement of a portion of the diagram of FIG. 4, showing greater detail of the output portion of the IR guide and ink-ejecting portion of the printhead.

FIG. 5 is an enlargement of a portion of the diagram of FIG. 4, showing greater detail of the emitter 416 or output portion of the IR guide, and ink-ejecting portion 502 of the printhead 304. IR energy travels down pipe 414, and is released from the emitter 416. The cross-sectional area of the IR energy released 504 from the emitter may broaden somewhat, before striking the print media 306. The scope of the IR light on the print media is slightly greater than the scope of the ink 506 ejected from the printhead 304.

FIG. 5 illustrates an example wherein the emitter 416 of the IR guide 212 is adjacent to the printhead 304. In some applications, care may be required in positioning the IR guide a sufficient distance from the printhead 304 to prevent printhead over-heating during operation. Printhead overheating may be minimized in any particular application by appropriate location of the emitter 416 and/or entire guide 212 with respect to the printhead 304. For example, where the IR is released from the emitter 416 after application of ink by the printhead 304 (i.e. where the guide follows the movement of the printhead during periods wherein IR is emitted from the guide), the printhead may be warmed less. Similarly, in other applications, the emitter 416 may be directed in a manner, apparent within the geometry of the application, which reduces the temperature of the printhead, while still resulting in rapid ink drying times.

Figure 6:
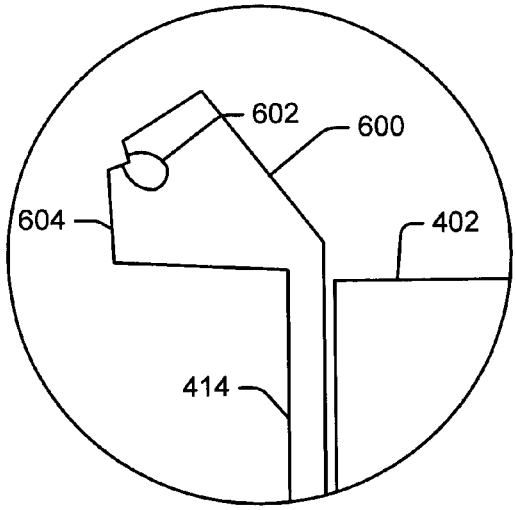
FIG. 6 is an enlargement of an alternative embodiment to the input portion of the IR guide of FIG. 4, where an IR lamp is built into the IR guide.

FIG. 6 is an enlarged view of an alternative to the collector input portion 412 of the IR guide 400 of FIG. 4. In the exemplary alternative collector of FIG. 6, the IR lamp is built into the IR guide. A bulb 602 is substantially centered within a reflector 604. Attachment of the reflector 604 to the collector 600 reduces loss of IR light, which may result in the light guide of FIG. 4, wherein the IR passes through a space between the reflector 406 and collector 412.

Figure 7:
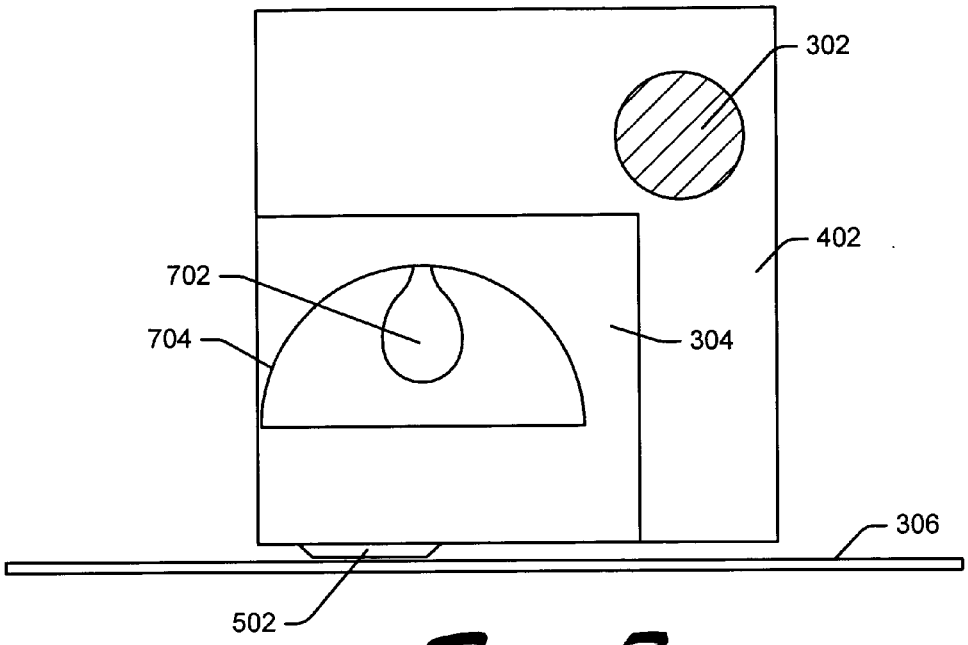
FIG. 7 is a diagram illustrating a further exemplary embodiment of the invention, wherein an IR lamp and guide concentrate heat energy.

FIG. 7 is a diagram illustrating a further exemplary IR lamp and guide for concentrating heat energy. As seen in earlier-described IR heating elements and IR guides, the carriage rod 302 supports the carriage 402 and a printhead 304. The printhead 304 includes an ink-ejecting surface 502, and is oriented to allow marking of print media 306. An IR bulb 702 emits IR light which is reflected to the print media by guide 704. The exemplary guide 704 is generally parabolic in shape, and is typically sized, shaped and located to result in IR striking the print media over the entire area on which ink has been, or will shortly be, applied.

In a manner similar to that illustrated in FIG. 3, the ink drying devices 702, 704 may be mounted on one or both sides of the printhead 304, so that the print media is warmed before and/or after application of ink.

Figure 8:
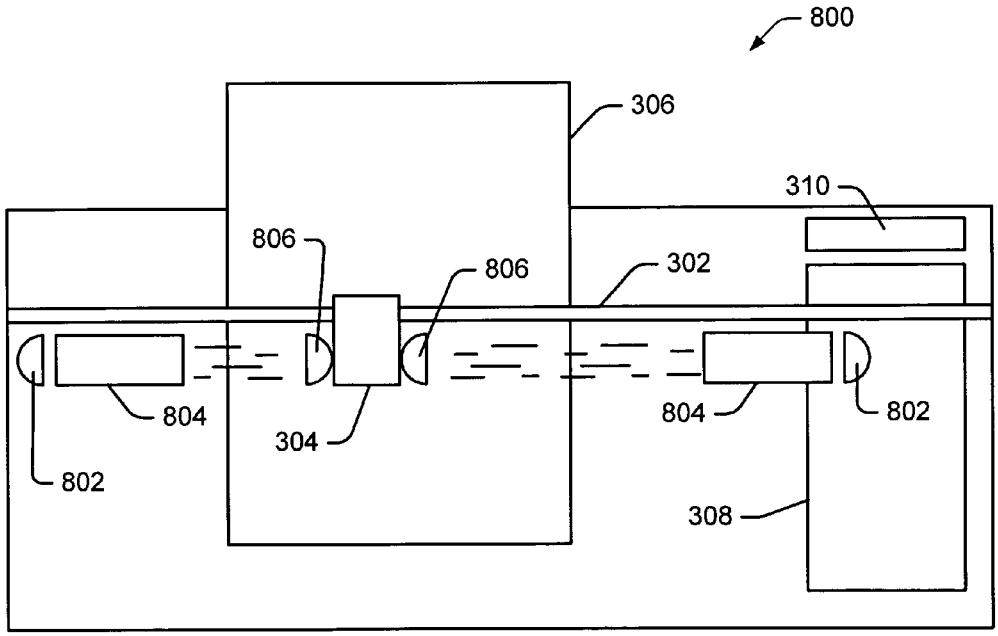
FIG. 8 is a diagram illustrating a printer having a further exemplary embodiment of an ink drying system.

FIG. 8 is a diagram illustrating a printer 800 having a further example of an ink drying system. A carriage rod 302 supports a printhead 304, allowing the printhead to move over print media 306, as well as into a printhead service station 308. A controller card 310 provides control over the printhead, the ink drying system and other components.

The ink drying system optionally includes left and right sides, thereby enabling the application of IR to media, both prior to printing and after printing, no matter which way the printhead is moving. Each ink drying system includes an IR lamp and a guide. The IR guide may include a reflector 802, a collimating device 804, and a light pipe 806. The collimating device 804 results in substantially linear travel of the IR energy between the reflector 802 and the light pipe 806. The light pipe 806 may be configured as seen in FIG. 4, having a collector 412, pipe 414 and emitter 416, or any other desired configuration.

Figure 9:
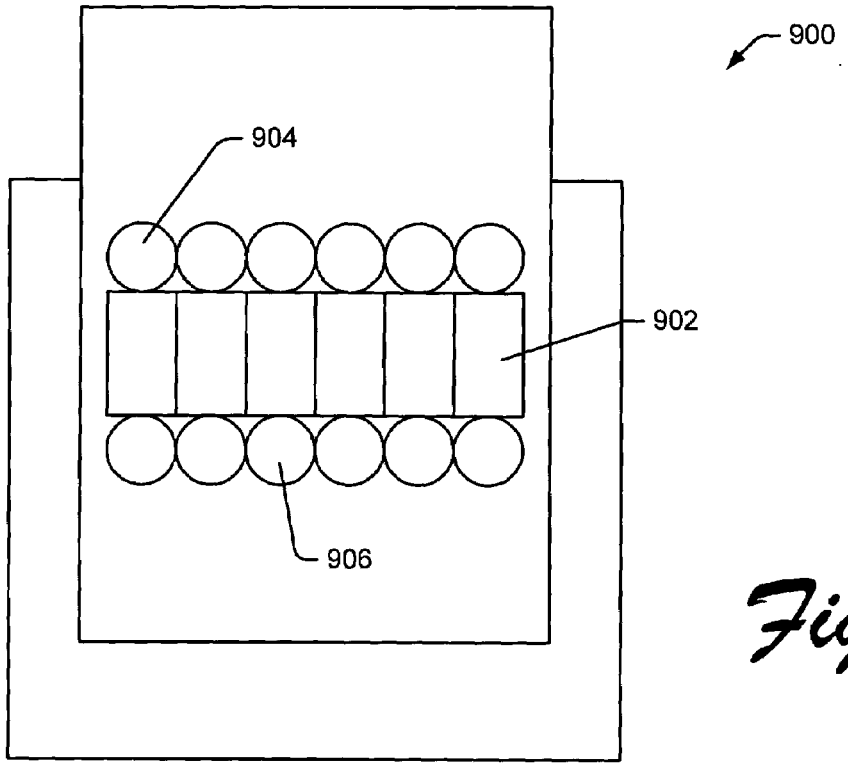
FIG. 9 is a diagram illustrating an exemplary embodiment of a page wide array print system, wherein the printheads remain stationary and the print media moves through a paper path adjacent to the printheads.

FIG. 9 is a diagram illustrating an exemplary page wide array print system 900, wherein a plurality of printheads 902 remains stationary and the print media 306 moves through a paper path adjacent to the printheads 902. Each printhead 902 may be configured with a forward IR heating element and guide 904 and/or a rearward IR heating element and guide 906. In the example illustrated, the IR heating elements include an IR lamp, and IR guides include a reflector similar to that seen in cross-section in FIG. 7. Other types of guides, such as the light pipe 410 of FIG. 4 could be substituted. In the exemplary configuration of FIG. 9, use of a forward IR heating element and guide 904 warms the print media prior to application of the ink, while use of a rearward IR heating element 906 warms the media after ink application. In a variation of the above exemplary system 900, left and/or right IR heating elements and guides could be substituted, if desired.

Figure 9A:
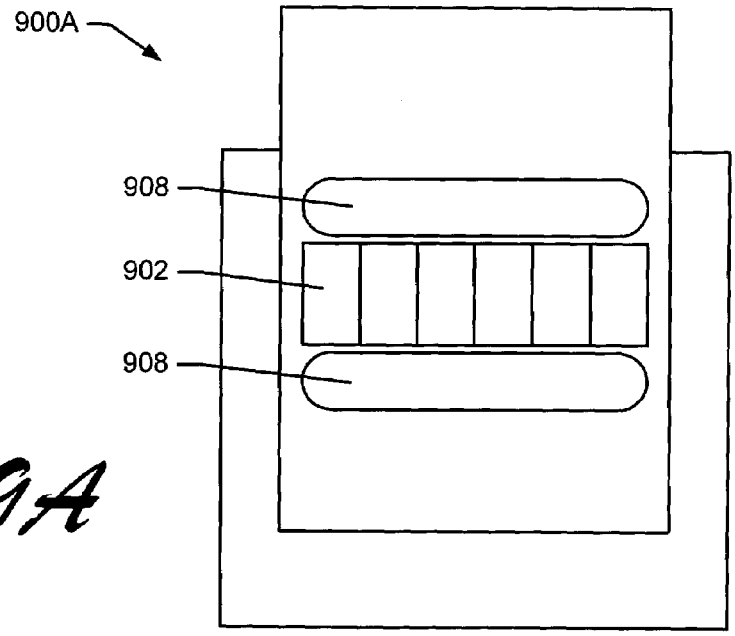
FIG. 9A is a further embodiment of the page wide array print system of FIG. 9.

A further variation of a page wide array print system 900A is seen in FIG. 9A. The print system 900A includes a single or compound IR heating element having a single guide 908 located in the forward and/or rearward position. Accordingly, the elongated reflector 908 is able to apply IR heat energy to the print media prior to, and/or after, application of ink. The single, elongated guide 908 could be utilized instead of individual guides associated with each printhead in either the forward and/or rearward locations 904, 906 of FIG. 9.

Figure 10:
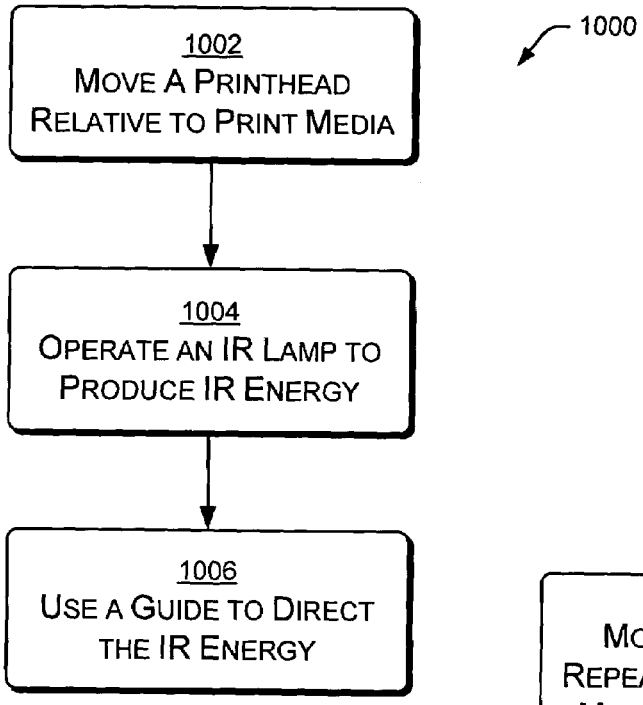
FIG. 10 is a flow chart illustrating an exemplary process for drying ink during printing.

FIG. 10 is a flow chart 1000 illustrating an exemplary process for drying ink during printing. At block 1002, a printhead is moved relative to print media. In one example, illustrated generally by FIGS. 3 and 8, the printhead moves alternately from left to right and right to left, while the print media moves from top to bottom. Alternatively, where a plurality of printheads is available, the print media may be moved while the printheads remain stationary. At block 1004, an IR lamp is operated to produce IR energy. At block 1006, a guide is used to direct the IR energy to specific locations on print media.

Figure 11:
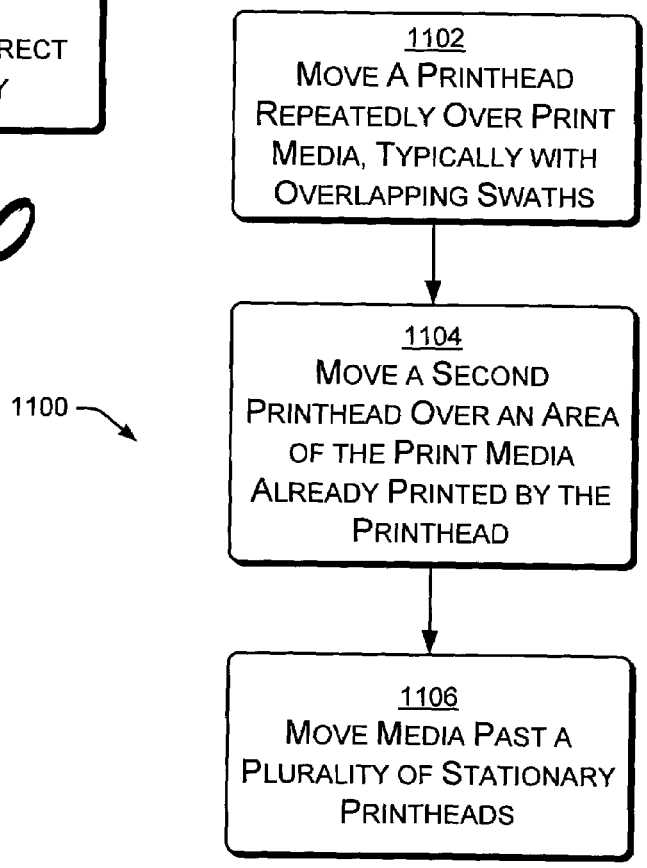
FIG. 11 is a flow chart illustrating exemplary methods by which one or more printheads may be moved with respect to print media.

FIG. 11 is a flow chart 1100 illustrating exemplary methods by which one or more printheads may be moved with respect to print media. At block 1102, a single printhead is moved through sequential passes over the print media, sometimes with substantial overlap. The overlap between passes may allow application of additional ink to the same or nearby locations on the print media. For example, a second color of ink may be deposited by the second pass, next to a first color of ink deposited by the first pass. The first and second colors of ink may be applied to the same location, or nearby locations, on the print media.

At block 1104, additionally, or as an alternative, a second printhead is moved over an area of print media to which ink has already been applied by a first printhead. For example, a first printhead may be configured to print in a first color; and a second printhead may be configured to print in a second color.

At block 1106, media is moved past a plurality of stationary printheads. For example, each of the plurality of stationary printheads may be configured to print on each of a plurality of vertical strips conceptually defined on the print media. Thus, print throughput is improved by continuously moving the print media.

Figure 12:
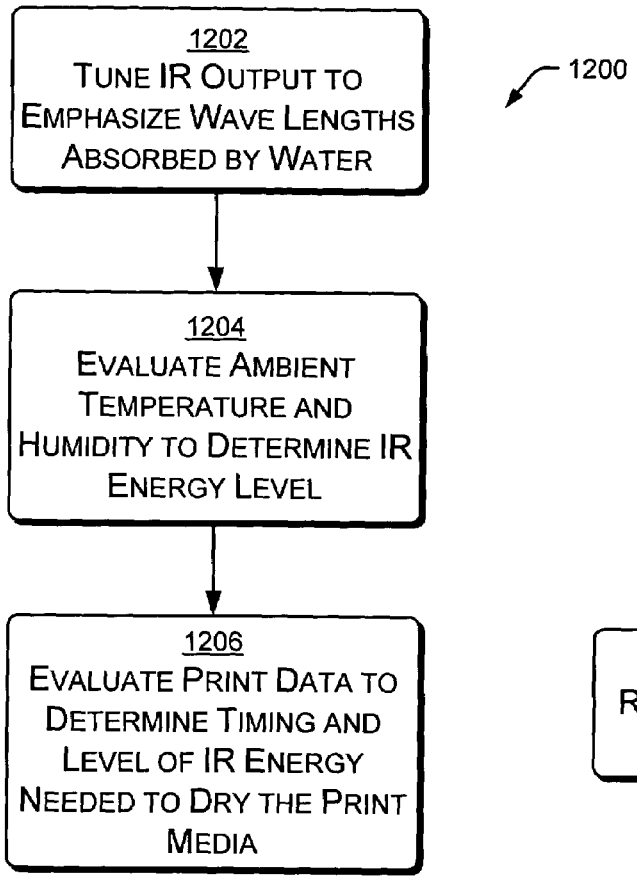
FIG. 12 is a flow chart illustrating exemplary methods by which an IR lamp may be operated.

FIG. 12 is a flow chart illustrating exemplary methods 1200 by which an IR lamp may be operated. At block 1202, IR light wavelength/frequency may be tuned to result in a greater percentage of the energy being absorbed by water components within ink applied to the print media, and a smaller percentage of the energy raising the ambient temperature. For example, where wavelengths are between 2.5 and 3.5 um and around 10 um, absorption of the IR energy by water present in ink is facilitated. Accordingly, such frequencies may be preferred over less desirable frequencies.

At block 1204, the ambient temperature and humidity are evaluated to determine desirable IR energy output. For example, lower temperature may indicate longer ink-drying times. Accordingly, additional IR energy could be used to compensate. Similarly, lower humidity may indicate shorter ink-drying times. Accordingly, use of less IR energy could be advantageous. As a result, the amount of IR energy used to dry ink may be a function of the ambient temperature and the ambient humidity. Thus, the controller procedure 216 (see FIG. 2) may use input from the sensors 214 to determine the time of operation and power level of the IR lamp 210.

At block 1206, print data may be evaluated to determine the level of IR energy generated, transmitted and/or required at any given time. For example, where the print data indicate that a greater amount of ink is being released by ink-ejecting printhead nozzles, then a greater amount of IR energy may be needed to dry that ink. Similarly, where the print data indicate that less ink is being used, less IR energy may be needed to dry the ink. Accordingly, the amount of IR energy generated may be regulated, to be proportional according to the print data. This may result, for example, in the IR lamp being turned off as print data in response to substantially blank regions of print media, when the printhead is turned off, or when one media sheet is ejected and another is put in position by a sheet feeding system. Greater quantities of IR may be produced in response to greater ink quantities. In response, the IR lamp may be caused to create more or less IR energy by applying a variable voltage or square wave to the IR lamp. These tasks may be performed by the controller procedure 216 (FIG. 2), which may be configured to evaluate the print data 206 as an input to the operation of the IR lamp 210.

Figure 13:
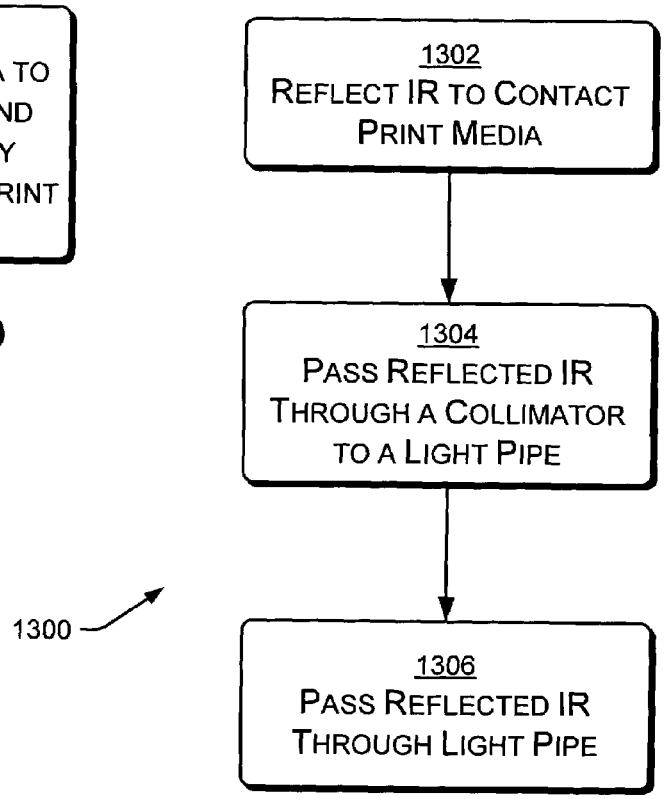
FIG. 13 is a flow chart illustrating exemplary methods by which a guide may be used to direct IR energy.

FIG. 13 is a flow chart illustrating exemplary methods by which a guide may be used to direct IR energy. At block 1302, reflected IR light may be directed to contact print media in a desired location. For example, as seen in FIG. 7, a reflector 704 may be used to reflect IR light generated by bulb 702. The reflector may be shaped as required to deliver light to the desired locations on the print media.

At block 1304, IR light from a bulb and/or reflector may optionally be passed through a collimator to a light pipe. For example, in FIG. 8, IR light released by a bulb within a reflector 802 is sent through a collimator 804, which reduces losses as the IR travels to a light pipe 806.

At block 1306, IR light from a bulb, reflector and/or collimator may optionally be passed through a light pipe. For example, in FIG. 4 a light pipe 410 is configured to receive IR light direct from a bulb and/or reflector. The IR light is received at the collector 412, transmitted through the pipe 414 and released from the emitter 416. The IR light, having been directed by the light pipe 410, dries ink deposited on the print media 306.

Although the disclosure has been described in language specific to structural features and/or methodological steps, it is to be understood that the appended claims are not limited to the specific features or steps described. Rather, the specific features and steps are exemplary forms of implementing this disclosure. For example, while actions described in blocks of the flow diagrams may be performed in parallel with actions described in other blocks, the actions may occur in an alternate order, or may be distributed in a manner which associates actions with more than one other block. And further, while elements of the methods disclosed are intended to be performed in any desired manner, it is anticipated that computer- or processor-readable instructions, performed by a computer and/or processor, typically located within a printer, reading from a computer- or processor-readable media, such as a ROM, disk or CD ROM, would be preferred. And finally, while specific reference to IR wavelengths has been mentioned, it is clear that other wavelengths, such as white light, etc., could be substituted in some applications, while still keeping within the teachings of the invention. However, IR heat is a preferred embodiment for several reasons. IR heaters result in better heating of the inside of a sheet of paper, as opposed to just the surface of the paper. IR may be configured to provide extremely high thermal transfer rates and fast heating with fast response rates. IR heating is easily controlled, thereby allowing the output of the heater to match the heat needed, given the quantity of ink to be dried. Moreover, IR heat is efficiently produced from electricity, with little electrical energy resulting in non-radiant heat.

The invention claimed is:

1. An ink drying system for a printer, comprising:

an IR heating element;

a guide, to concentrate heat energy from the IR heating element on print media, wherein the guide comprises:

a collimator to direct IR energy in a substantially straight line, substantially parallel to a carriage rod upon which a printhead travels; and a light pipe, movable along a direction parallel to the carriage rod, to receive IR energy from the collimator and to deliver IR energy to print media adjacent to the printhead; and a controller procedure to control operation of the IR heating element.

2. The system of claim 1, additionally comprising:

sensors, in communication with the controller procedure, to measure relative humidity and temperature.

3. The system of claim 1, wherein the controller procedure additionally considers print data as a constraint to control operation of the IR heating element.

4. The system of claim 1, wherein the controller procedure causes the IR heating element to put out more heat in locations on the print media where print data indicate extensive use of ink than in locations where the print data indicate moderate use of ink.

5. The system of claim 1, wherein the guide is located on a print carriage.

6. The system of claim 1, wherein IR heating elements are located on both sides of a printhead carried by a print carriage.

7. The system of claim 1, wherein the light pipe comprises: a collector; a pipe, in communication with the collector; and an emitter, in communication with the pipe.

8. The system of claim 1, wherein the guide comprises:

a reflector to direct IR energy to the collimator.

9. The system of claim 1, additionally comprising:

wherein first and second guides are configured for operation in first and second directions of printhead movement.

10. The system of claim 1, wherein the light pipe is located in a forward position, configured to warm print media prior to application of ink.

11. The system of claim 1, wherein the light pipe is located in a rearward position, configured to warm print media after application of ink.

* * * * *